United States Patent [19]

Mayer

[11] Patent Number: 4,487,039

[45] Date of Patent: Dec. 11, 1984

[54] WEFT MAGAZINE ARRANGEMENT FOR WARP KNITTING MACHINES

[75] Inventor: Ingo Mayer, Obertshausen, Fed. Rep. of Germany

[73] Assignee: Karl Mayer Textilmaschinenfabrik GmbH, Fed. Rep. of Germany

[21] Appl. No.: 534,127

[22] Filed: Sep. 20, 1983

[30] Foreign Application Priority Data

Sep. 21, 1982 [DE] Fed. Rep. of Germany ..... 3234827

[51] Int. Cl.[3] ..... D04B 23/06; D04B 23/08; D04B 23/10; D04B 23/12

[52] U.S. Cl. ..... 66/84 A; 66/146; 66/210; 66/212

[58] Field of Search ..... 66/84 A, 85 A, 209, 66/210, 212, 146

[56] References Cited

U.S. PATENT DOCUMENTS

| | | | |
|---|---|---|---|
| 3,564,872 | 3/1969 | Klaeui | 66/85 A |
| 3,636,731 | 1/1972 | Jones | 66/84 A |
| 3,681,942 | 8/1972 | Bassist | 66/84 A |
| 3,727,033 | 4/1973 | Bassist | 66/209 |
| 3,746,226 | 7/1973 | Leclercq | 66/146 |
| 3,747,372 | 7/1973 | Nickell et al. | 66/209 |
| 3,785,175 | 1/1974 | Kamp | 66/84 |
| 3,854,415 | 1/1975 | Wilson et al. | 66/210 |
| 3,858,416 | 1/1975 | White et al. | 66/146 |
| 4,348,876 | 9/1982 | Roth | 66/85 A |

*Primary Examiner*—Ronald Feldbaum
*Assistant Examiner*—Mary A. Ellis
*Attorney, Agent, or Firm*—Omri M. Behr

[57] ABSTRACT

In a weft thread magazine arrangement for a warp knitting machine there are provided a pair of transport arrangements positioned on each side of the machine. Also included is a carriage which lays threads in a continual manner from the transport arrangement on one side to the transport arrangement on the other. There is also provided a roller delivery arrangement to deliver the weft threads over a directional turning arrangement. The drive of said roller delivery arrangement is continually influenced by the speed and position of the carriage at any given moment. Suitably, this may be achieved by a computer controlled DC motor.

16 Claims, 3 Drawing Figures

WEFT MAGAZINE ARRANGEMENT FOR WARP KNITTING MACHINES

BACKGROUND OF THE INVENTION

1. Field of the Invention

The present invention relates to weft thread magazine arrangements for warp knitting machines which have a pair of transport arrangements (one being provided to one side of the machine and the other to the other side of the machine); a carriage which continually carries weft threads from one transport arrangement to the other and back; a turning arrangement for the weft threads; and a roller delivery arrangement for delivering the weft threads to said turning arrangement, the delivery arrangement being driven in dependence upon the movement of the carriage.

2. Discussion of the Relevant Art

In a known weft thread magazine arrangement of this general type, (e.g., German OLS No. 28 12 032), the drive for the carriage is coupled with a roller delivery device for the provision of weft thread by means of a slip coupling. This slip coupling operates in such a way that during motion of the carriage in one direction, the circumference of the delivery roller moves at double the carriage speed and that during the movement of the carriage in the opposite direction the delivery rollers receive no drive at all. The temporary excess of delivered weft thread is taken up by a spring loaded storage device. In this way the exact amount of thread required for the back and forth motions of the weft thread is exactly metered. During the progress of the cycle however, the tension of the weft thread varies substantially.

It is further known (German OLS No. 24 53 682) that a plurality of weft threads may be delivered via a friction thread delivery arrangement. The circumferential speed of the friction rollers is at least twice as great as the maximum speed of the thread takeoff. The greater the tension of the particular weft threads the greater the forwarding speed through the friction rollers. This permits a reduction of tension differences and tension peaks.

Accordingly, there is a need to provide a weft thread magazine arrangement of the general type discussed hereinabove wherein, however, the variation of the tension values of the weft threads are reduced considerably below that which was heretofore possible.

SUMMARY OF THE INVENTION

A weft thread magazine arrangement for a warp knitting machine according to the principles of the present invention has a spaced pair of transport means. These transport means are positioned on either side of the machine for carrying the weft thread into the machine. The magazine arrangement also includes a carriage means mounted for transverse reciprocation at the machine for laying successive rows of the weft thread onto the transport means. Also included is a delivery means coupled to the knitting machine and responsive to the motion of the carriage means for issuing the weft thread to the carriage means at a variable issue speed having a predetermined relationship to the position and speed of the carriage means.

A related method of the same invention can deliver weft thread from a delivery device through a transversely reciprocatable carriage to a pair of transporters that feed a knitting machine. The method includes the step of laying successive transverse rows of weft thread across the transporters by reciprocating the carriage. Another step is issuing the weft thread from the delivery device at a exit speed changing according to a predetermined relationship with the position and speed of the carriage.

By employing the foregoing apparatus and methods, improved operation is provided by the present invention in that the drive of the roller delivery arrangement can be continually alterable in dependence upon the state of the carriage speed and position at a given moment.

This mode of construction provides a continuous drive for the weft threads, however, a drive with varying speed. This speed is adjusted not only with respect to the mean speed of the weft carriage but also with respect to the actual position of the carriage. Thus, the change in the geometric course of the weft thread between the turning direction and the guide elements on the carriage are taken into account. This makes it possible to provide for a higher level of tension constancy during the entire delivery of the weft threads. Thus, an increase in tension of the weft thread in the middle of the motion path of the carriage or a decrease in tension in the direction reversal position of the carriage, is avoided by a corresponding increase or decrease of the drive speed of the roller delivery means. Furthermore, attention may be paid to the fact that the weft thread speed decreases before the reversal point and increases after said point. The arrangement can operate efficiently quite independently of the strength or nature of the thread.

BRIEF DESCRIPTION OF THE DRAWINGS

In order that the invention may be more fully understood, it will now be described, by way of example, with references to the accompanying drawings showing a preferred embodiment in which.

DETAILED DESCRIPTION OF THE PREFERRED EMBODIMENT

Figure 1:
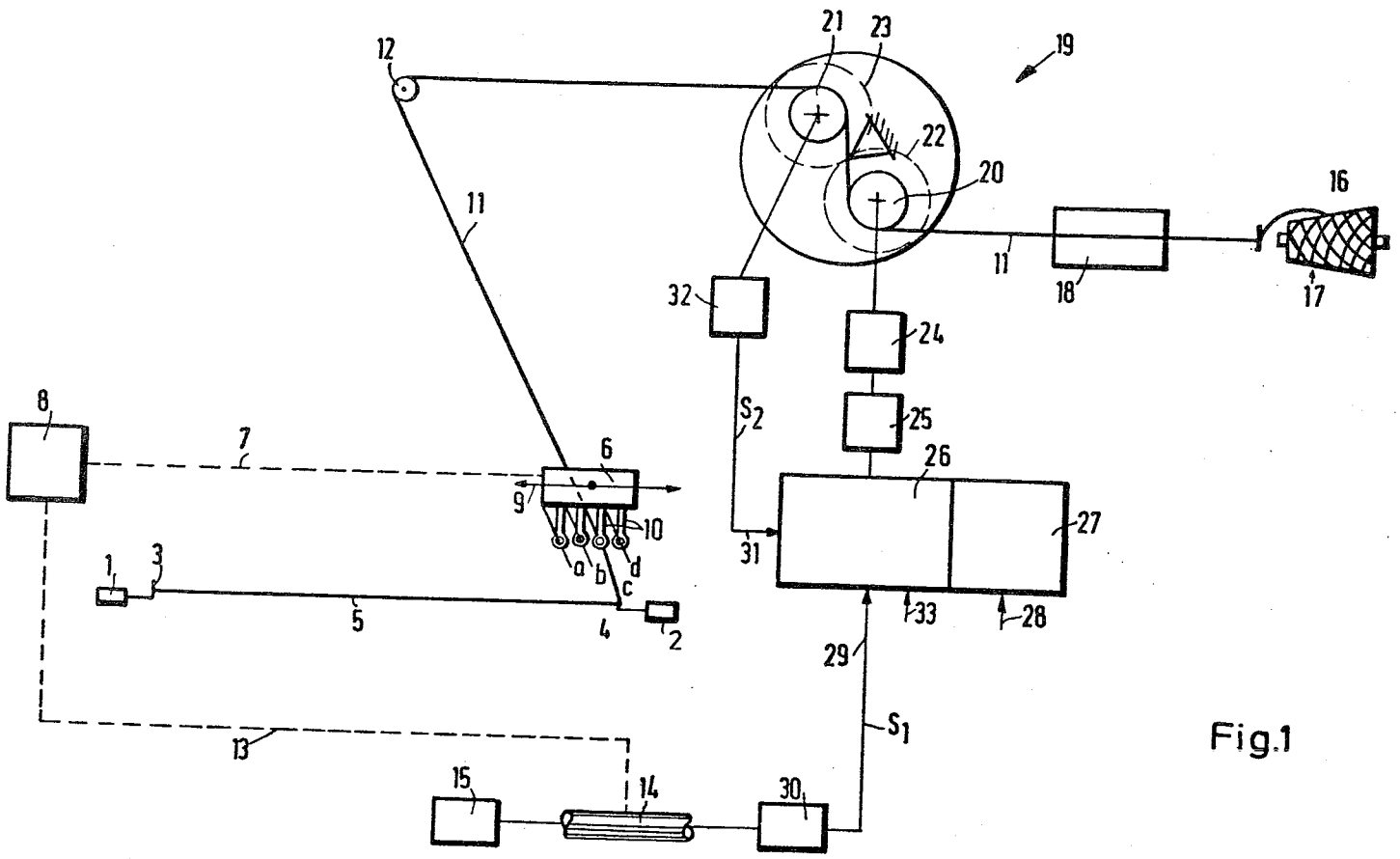
FIG. 1 shows a schematic representation of a weft thread magazine arrangement in accordance with the present invention.

Referring to FIG. 1, it shows a magazine arrangement working with a conventional warp knitting machine (not illustrated). The transport arrangements 1 and 2 are provided on either side of the machine in a conventional manner. In one embodiment arrangements 1 and 2 are a pair of chains, each formed in an endless loop. A plurality of holding arrangements 3 and 4, typically in the shape of rounded knobs or hooks, are mounted on each of the transport arrangements 3 and 4, respectively, in order to hold weft threads 5 laid parallel to the needle bed (not shown) of said warp knitting machine.

Carriage 6 runs on track 7 activated by drive means 8 in a to and fro mode between transport arrangements 1 and 2, as indicated by the double headed arrow 9. Carriage 6 may be a frame rolling on parallel tracks as illustrated in U.S. Pat. No. 4,385,506. Carriage 6 carries a plurality of thread guide elements 10 indicated as a through d, each carrying a weft thread from sheet 11.

These weft thread sheets are provided over a direction turning roller 12. The drive means 8 of the carriage 6 is powered, via mechanical coupling 13 with main shaft 14 of the warp knitting machine which in turn is driven by main motor 15. The travel speed of the carriage is set so that when n guide elements 10 are used, main shaft 14 must complete n rotations to cycle carriage 6 from transport arrangement 2 to the other transport arrangement 1 and back again.

It is further advantageous if the turning arrangement 12 is located substantially in the middle of the machine width and the drive speed of the roller delivery arrangement 19 is provided to vary periodically about a mean value. The symmetrical structure of the weft thread magazine arrangement provides a point of rotationally symmetrical operation of the delivery speed, which gives rise to a substantial simplification of the calculation and storage of the particular values corresponding to the thread settings.

The threads of the thread sheet 11 are drawn from spools 16 on creel 17. They run thru a conventional braking and tensioning arrangement 18 and are delivered to a roller delivery arrangement 19. Said arrangement 19 comprises two rollers 20 and 21 which are coupled to each other via gear wheels 22 and 23 attached to adjacent ends of rollers 20 and 21, respectively. Gear 22 is driven by controllable DC motor 24. The weft threads are thus pulled from the spools 16, with a speed determined by the rate of rotation of the rollers of delivery arrangement 19, and delivered to carriage 6. It is advantageous to drive the roller delivery means 19 by controllable DC motor 24 since this permits a particularly simple alteration of the delivery speed.

The DC motor 24 is controlled to run at variable speeds by means of setting arrangement 25 which can produce an adjustable DC signal. The setting arrangement 25 receives its command from digital computing arrangement 26, having a storage means 27 provided thereto. In a constructed embodiment device 26 was a type 8741 microprocessor manufactured by Intel of Santa Clara, Calif. Memory 27 comprised an EPROM type 2732 and RAM type 6116 both manufactured by Intel. In this storage means 27 certain predetermined positions of carriage 6 may be manually entered via input means 28.

The computer 26 comprises input means 29, a digital input to which pulse generator 30 provides signal S1 for characterizing the carriage speed and position. This pulse generator 30 is dependent upon the rotation of the main shaft 14 and provides a single pulse for a predetermined angle of rotation. In a constructed embodiment generator 30 was an incremental revolution counter manufactured by Heidenhain Co., Traunreut, West Germany. Signal S2 is provided to second digital input 31 from pulse generator 32 which characterizes the circumferential speed of roller 21 at a given instant. Generator 32 can be constructed similarly to generator 30.

It is particularly advantageous to provide computer 26 with a memory storage means 27 in which a value is stored for each of a predetermined number of carriage positions, which take into account the length of the weft thread between the turning arrangement and the carriage 6. The stored values can, for example, be provided on the basis of empirical measurements. Based upon the provided position signals S1, a computation value may be called out of the memory from which the drive speed of the roller delivery arrangement may be calculated.

The computer arrangement 26 can further provide a setting input 33 for a correction value, for example, a desired thread tension. In this way the delivery speed may be corrected as desired, for example, reduced by a predetermined percentage. Certain correction values, for example for the establishing of a particular level of thread tension, may be provided through this third input 33, which may be a conventional keyboard marked with various numbers and symbols, (e.g. keyboards manufactured by Epis Co.).

Figure 3:
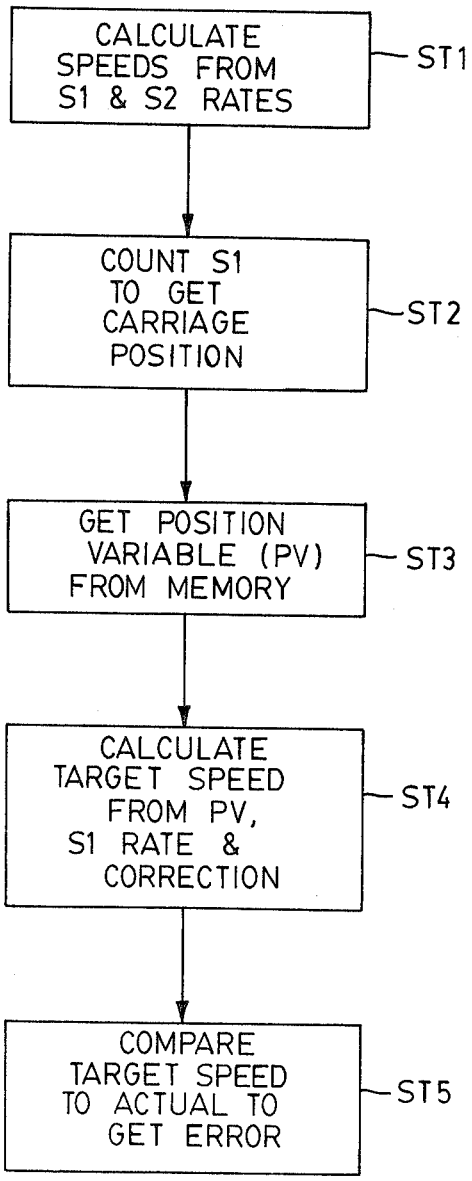
FIG. 3 is a flow chart showing the programmed operation of the microcomputer of FIG. 1.

With the foregoing inputs, a speed control loop can be formed about motor 24. Input signal S1 permits computer 26 to obtain a specific computation variable corresponding to the position of the carriage, from the storage means 27. Using this computation variable and the carriage speed (calculable from said signal S1) and similarly from a correction value, a target value for the drive speed of the roller delivery arrangement 19 can be calculated. This target value is compared to the measured value of speed from signal S2 and in dependence upon the error, the drive speed of motor 24 is changed. The computer arrangement 26 thus also acts as a control means. A flow chart of this operation performed by computer 26 is illustrated in FIG. 3, showing steps ST1, ST2, ST3, ST4 and ST5.

To facilitate an understanding of the principles of the foregoing apparatus, its operation will be briefly described. In this example, it is assumed that the carriage 6 has "n" weft threads and that a cycle of the drive speed of the roller delivery means 19 comprises "n" revolutions of the main shaft. In such a construction the actual speed of the carriage 6 is comparatively low, this in turn means that the unavoidable time delays involved in a position dependent signal for the delivery speed do not play a substantial part.

As main shaft 14 rotates and carriage 6 reciprocates, pulse generator 30 applies pulse S1 indicating the incremental advancement of shaft 14 to input 29 of computer 26. In a straight-forward manner pulses S1 are used to characterize the carriage speed and position from pulse generator 30 whose output S1 depends upon the rotation of main shaft 14. Since the pulses always correspond to a particular angle of rotation, the position of carriage 6 is defined. Since pulses S1 also follow each other more rapidly with increasing rate of rotation, the speed of the carriage 6 is also thus defined (see steps ST1 and ST2 of FIG. 3). It is particularly advantageous if computer 26 determines the drive speed of the roller arrangement 19 at a particular moment, said computer being provided with an input indicating the specific carriage speed and carriage position. Computer 26, which is preferably a digital computer but also may be of a mechanical construction, can calculate the feeding speed by taking into account the carriage speeds, the carriage position and the special construction and setting of the thread magazine arrangement. This is necessary to insure the substantial constancy of the thread tension.

Figure 2:
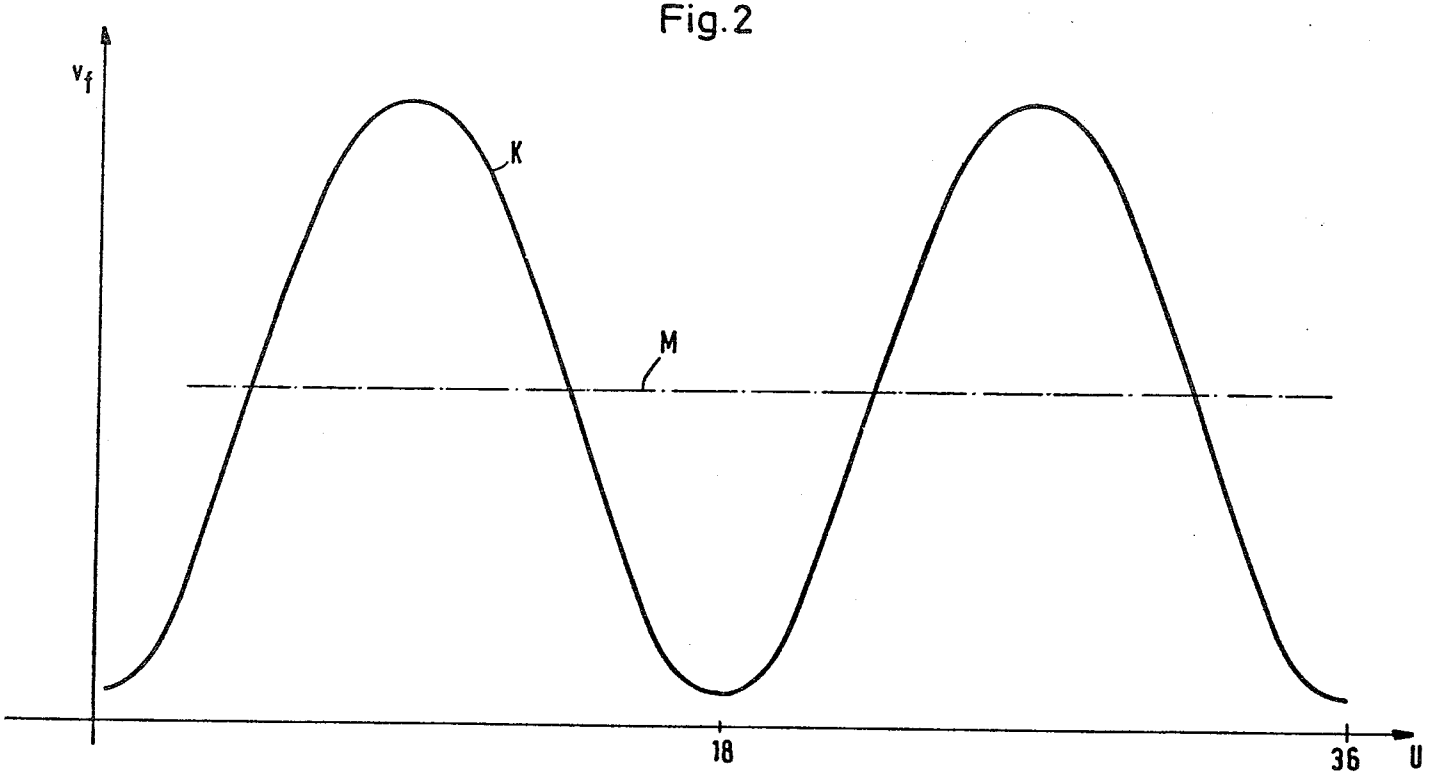
FIG. 2 shows the pattern of the thread delivery speed in dependence upon the rate of revolution of the main shaft.

FIG. 2 shows the feeding speed $V_f$ of the weft thread (that is, the circumferential speed of rollers 20 and 21 of the roller delivery means 19) for a complete working cycle of the carriage 6, that is, a forward and backward movement. FIG. 2 presumes that 18 guide elements 10 (FIG. 1) are provided to carriage 6, thus the cycle comprises 36 revolutions U of the main shaft. This pattern comprises a sinusoidal curve K having a midline M equal to the mean speed M of the carriage 6. If 24 guide elements 10 were provided, the work cycle would comprise 48 revolutions of the main shaft.

In one embodiment the position of carriage 6 (FIG. 1) is determined by counting pulses S1 to arrive at the present position. The relation between carriage position and pulse S1 may be linear. The specific relation is programmed into computer 26.

For preprogrammed positions (or in some case for every discrete position) there is a corresponding calculation variable stored in memory which is retrieved on a real-time basis. This calculation variable can represent a desired ratio between the speed (or angular position) of roller arrangement 19 and main shaft speed (or position). Using this calculation variable the desired speed of rollers 19 can be readily calculated (step ST4, FIG. 3). This desired roller speed may be offset by some percentage as demanded by correction input 33. This desired speed is then compared (step ST5) to the actual carriage speed determined from pulses S2 (step ST1, FIG. 3).

It is particularly advantageous to now utilize computer 26, which calculated the target value of the drive speed of the roller delivery means 19 at a particular moment, to compare that target value to the actual value (from generator 32) as it changes, depending upon the carriage speed and position. In this way the actual delivery speed can be exactly followed up by means of the predetermined target value for the carriage speed and setting.

Accordingly, motor 24 is controlled to achieve the target speed. Preferably motor 24 is a DC motor, continuously variable in speed, but in some embodiments DC motor 24 need not be controlled steplessly. There may be employed a drive of at least 20 steps preferably however, 80 to 100 steps.

It will be understood that various changes in the details, materials, arrangement of parts and operating conditions which have been described and illustrated in order to explain the nature of the invention may be made by those skilled in the art within the principles and scope of the instant invention. For example, there exists the possibility of transferring a signal characterizing the carriage speed or position over a mechanical drive of carriage 6, suitably its driving means. This is particularly desirable if the computer arrangement is either a mechanical one or operates in an analog manner.

The illustrated curve K may be affected by the change in width between the two transport arrangements 1 and 2 (FIG. 1). This can also be achieved by another program in memory 27. The creation of this program may be achieved in the simplest manner if the thread usage per machine revolution for different positions of the carriage 6 is determined from the pulse generator 32 and fed to the memory 27.

What is claimed is:

1. A weft thread magazine arrangement for a warp knitting machine comprising:

a spaced pair of transport means positioned on either side of said machine for carrying the weft thread into said machine;

a carriage means mounted for transverse reciprocation at said machine for laying successive rows of the weft thread onto said transport means; and delivery means coupled to said machine and responsive to the motion of said carriage means for issuing the weft thread to said carriage means at an variable issue speed having a predetermined relationship to the position and speed of said carriage means.

2. A weft thread magazine arrangement according to claim 1 further comprising:

roller means positioned between said delivery means and said carriage means for turning said weft thread toward said carriage means.

3. A weft thread magazine arrangement according to claim 2 wherein said delivery means includes:

a controllable motor operable at an adjustable speed.

4. A weft thread magazine arrangement according to claim 3 wherein said delivery means includes:

input means coupled to said machine to provide a characterization signal signifying the speed and position of said carriage means; and computing means coupled to said input means and responsive to said characterization signal for applying a drive signal to said motor to control its drive speed.

5. A weft thread magazine arrangement according to claim 4 wherein said knitting machine has a main shaft and wherein said input means comprises:

a pulse generator coupled to said main shaft for producing pulses at a rate proportional to the speed of rotation of said main shaft.

6. A weft thread magazine arrangement according to claim 5 wherein said computing means includes:

memory means for storing and retrieving each of a plurality of stored values, each of said stored values being related to the length of weft thread between said roller means and carriage means when the latter is in a corresponding one of a plurality of carriage positions.

7. A weft thread magazine arrangement according to claim 6 wherein said computing means includes:

an adjustment input means for receiving a correction value and adjusting the variable issue speed of said delivery means by adjusting said drive signal at said motor.

8. A weft thread magazine arrangement according to claim 7 wherein said correction value is a desired thread tension and wherein said variable issue speed is adjusted by a percentage bearing a predetermined relation to said correction value, whereby weft thread tension is adjusted.

9. A weft thread magazine arrangement according to claim 8 further comprising:

a speed sensing means coupled to said delivery means and said computing means for providing to the latter an exit signal which varies in dependence upon the variable issue speed of said delivery means, said computing means including means for calculating a target value signifying a target speed for thread issuing from said delivery means, said target value being calculated by said computing means by deriving from the pulses of said pulse generator the speed and position of said carriage means.

10. A weft thread magazine arrangement according to claim 9 wherein said carriage means includes a predetermined number of thread guides for guiding said weft thread, said main shaft executing said predetermined number of cycles for each cycle of said carriage means.

11. A weft thread magazine arrangement according to claim 10 wherein said roller means is positioned alongside and centered with respect to said pair of transport means, said variable issue speed of said delivery means oscillating about a mean value.

12. A method for delivering weft thread from a delivery device through a transversely reciprocatable carriage to a pair of transporters that feed a knitting machine, comprising the steps of:

laying successive transverse rows of said weft thread across said transporters by reciprocating said carriage; and issuing the weft thread from said delivery device at a time-varying variable issue speed having a predetermined relationship to the position and speed of the carriage.

13. A method according to claim 12 further comprising the step of changing the direction of the weft thread at a fixed position between said delivery device and said carriage.

14. A method according to claim 13 wherein said knitting machine has a main shaft and wherein said variable issue speed from said delivery device is varied according to a predetermined pattern, said pattern being followed at a rate determined by rotation of said main shaft.

15. A method according to claim 13 wherein said knitting machine has a main shaft and wherein said variable issue speed from said delivery device is varied according to a predetermined pattern, said pattern being followed according to the position and speed of said carriage.

16. A method according to claim 14 wherein the change of direction of the weft thread occurs at a position alongside and centered with respect to the transporters, said variable issue speed of said delivery device oscillating about a mean value.

* * * * *